US006195903B1

(12) United States Patent
Inglehart

(10) Patent No.: US 6,195,903 B1
(45) Date of Patent: Mar. 6, 2001

(54) TOOLS FOR SQUARING ENDS OF ELONGATED OBJECTS

(76) Inventor: Brock Inglehart, 7617 E. C Ave., Richland, MI (US) 49083-9739

( * ) Notice: Subject to any disclaimer, the term of this patent is extended or adjusted under 35 U.S.C. 154(b) by 0 days.

(21) Appl. No.: 09/306,115

(22) Filed: May 6, 1999

Related U.S. Application Data

(60) Provisional application No. 60/089,230, filed on Jun. 15, 1998.

(51) Int. Cl.[7] ..... B43L 7/10

(52) U.S. Cl. ..... 33/454; 33/456; 33/32.1; 33/42

(58) Field of Search ..... 33/32.1, 32.7, 33/42, 452, 454, 456, 468, 478, 479, 481, 25.1, 25.2, 32.2, 32.3, 520, 535, 644

(56) References Cited

U.S. PATENT DOCUMENTS

| | | | | |
|---|---|---|---|---|
| 171,803 | * | 1/1876 | Henderson | 33/454 |
| 692,794 | * | 2/1902 | Morley | 33/454 |
| 827,233 | * | 7/1906 | Gould | 33/454 |
| 2,411,718 | * | 11/1946 | Feld | 33/25.2 |
| 2,842,860 | * | 7/1958 | Gray | 33/520 |
| 4,351,117 | * | 9/1982 | Wade | 33/454 |
| 5,437,105 | * | 8/1995 | Work | 33/644 |

* cited by examiner

*Primary Examiner*—G. Bradley Bennett
(74) *Attorney, Agent, or Firm*—Baker & Daniels

(57) ABSTRACT

A tool for cutting the ends of conveyor belts square includes a T square having a cross leg standing transverse to the belt when the tool is used and a primary leg extending longitudinally along the belt. A pair of end links are adapted to engage opposite sides of the belt when the tool is used. The end links are pivotally connected to each of three cross links, which are pivotally connected to the primary leg of the T square at the midpoints of the cross legs. Accordingly, the primary leg lies along the center line of the conveyor belt when the end links are brought into engagement with the sides of the conveyor belt. By cutting along the cross leg, the belt is cut square to the center line of the belt.

9 Claims, 3 Drawing Sheets

TOOLS FOR SQUARING ENDS OF ELONGATED OBJECTS

This application claims benefit of Provisional Application Ser. No. 60/089,230 filed Jun. 15, 1998.

This invention relates to a tool for assuring that the ends of the elongated objects, such as conveyor belts, are cut square.

Conveyor belts are commonly used in many industrial applications to transport materials for processing. These belts are commonly made out of durable material, but because of the heavy use which often occurs in industrial productions, the belts must be replaced at regular intervals. When replacing the belt, the old belt is cut off the rollers which support the belt, and the new belt is placed on the rollers with the ends of the belt adjacent one another. The ends must be cut square to the center line of the belt and then laced together to complete the installation. If the ends of the belt are not cut square to the belt center line, the belt will "wander" on the rollers that is, the belt moves laterally from side to side. This is obviously undesirable, but can be avoided only if the ends of the belt are cut square to the center line.

The recommended prior art procedure for squaring the ends of conveyor belts was to draw three diagonal lines of equal length across the belt, and then measuring to find the midpoints of the lines. The long leg of a T-square was placed as closely as possible to connect the three midpoint marks and the belt was cut along the cross leg of the T-square. Because this procedure was so complicated, as a practical matter it was rarely done and belts were cut using a carpenter's square which was placed along one side of the belt to guide cutting of the belt. This procedure rarely results in accurate, square cuts, because the carpenter's square was easily moved during the procedure. Even if the square is not moved, squaring the belts to the center, as in the recommended procedure, is inherently more accurate than squaring the belt to one edge.

According to the invention, three cross links of the same length are pivotably connected at their ends to a pair of end links. A primary leg of a T-square is pivotably connected at the midpoint of each of the three cross links and extends to a cross leg of the T-square which is welded to the primary leg at a right angle thereto. Accordingly, the cross links are placed across the width of the belt to be cut, and the end links are then moved against the opposite edge of the belt. Due to the pivot connection between the cross lengths and the end lengths, the cross lengths extend diagonally across the belt. Since the primary leg is connected at the center of the cross links, the primary leg will extend along the center line of the belt and the cross leg will extend at a true right angle to the center line. The belt can then be cut along the cross leg. Because of the pivoting connection between the cross links and the end links, the squaring tool can accommodate a reasonably wide range of belt widths, but multiple squaring tools will be necessary to accommodate all possible conveyor belts, which may be as narrow as four inches wide, or as wide as forty-eight inches or wider.

These and other advantages of the present invention will become apparent for the following description, with reference to the accompanying drawings, in which.

Figure 1:
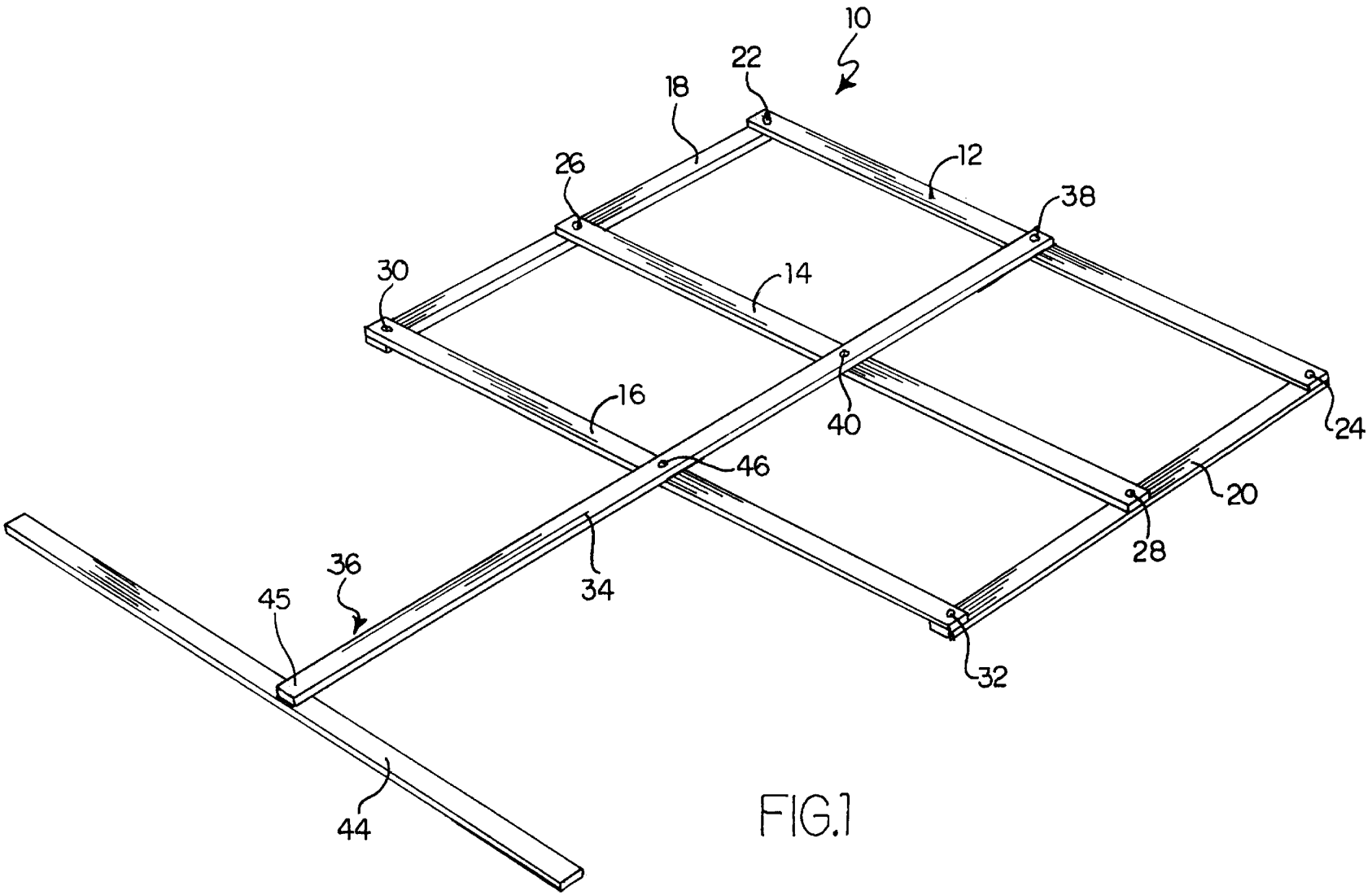
FIG. 1 is a view in perspective of a squaring tool made pursuant to the teachings of the present invention.

Referring now to the drawings, a squaring tool generally indicated by the numeral 10 includes cross links 12, 14 and 16, all of the same length. End links 18, 20 are connected to the ends of the cross links 12, 14, and 16. The end links 18 and 20 are each positioned below the cross links 12, 14, and 16, viewing FIG. 1. Pivot connections 22, 24 connect the cross links 12 to the end links 18 and 20 respectfully; pivot connections 26, 28 connect the cross links 14 to the end links 18 and 20 respectfully; and pivot connections 30, 32 connect the cross link 16 with the end links 18 and 20 respectfully. The length of the segment between the pivot connections 22 and 26 of end link 18 is measured to be the same as the distance between the pivot connection 26 and 30, and the length of the segment of end link 20 between the pivot connections 24 and 28 is measured to be the same as the length of the segment between pivot connections 28 and 32, so that cross links 12, 14 and 16 extend parallel to one another. Similarly, the length of cross links 12 between the pivot connections 22 and 24 is the same as the length of cross link 14 between the pivot connections 26 and 28, which is also the same as the length of the cross link 16 between the pivot connections 30 and 32. The pivot connections 22–32 may be, for example, rivets of a type well known in the art. A primary leg 34 of a T-square generally indicated by the numeral 36 is secured to the midpoint of the cross links 12, 14, and 16 by pivot connections 38, 40 and 42. The pivot connections 38–42 may be the same type of rivets as are used in pivot connection 22–32. A cross leg 44 of T-square 36 is welded to the end 45 of primary leg 34 at right angles thereto.

Figure 2:
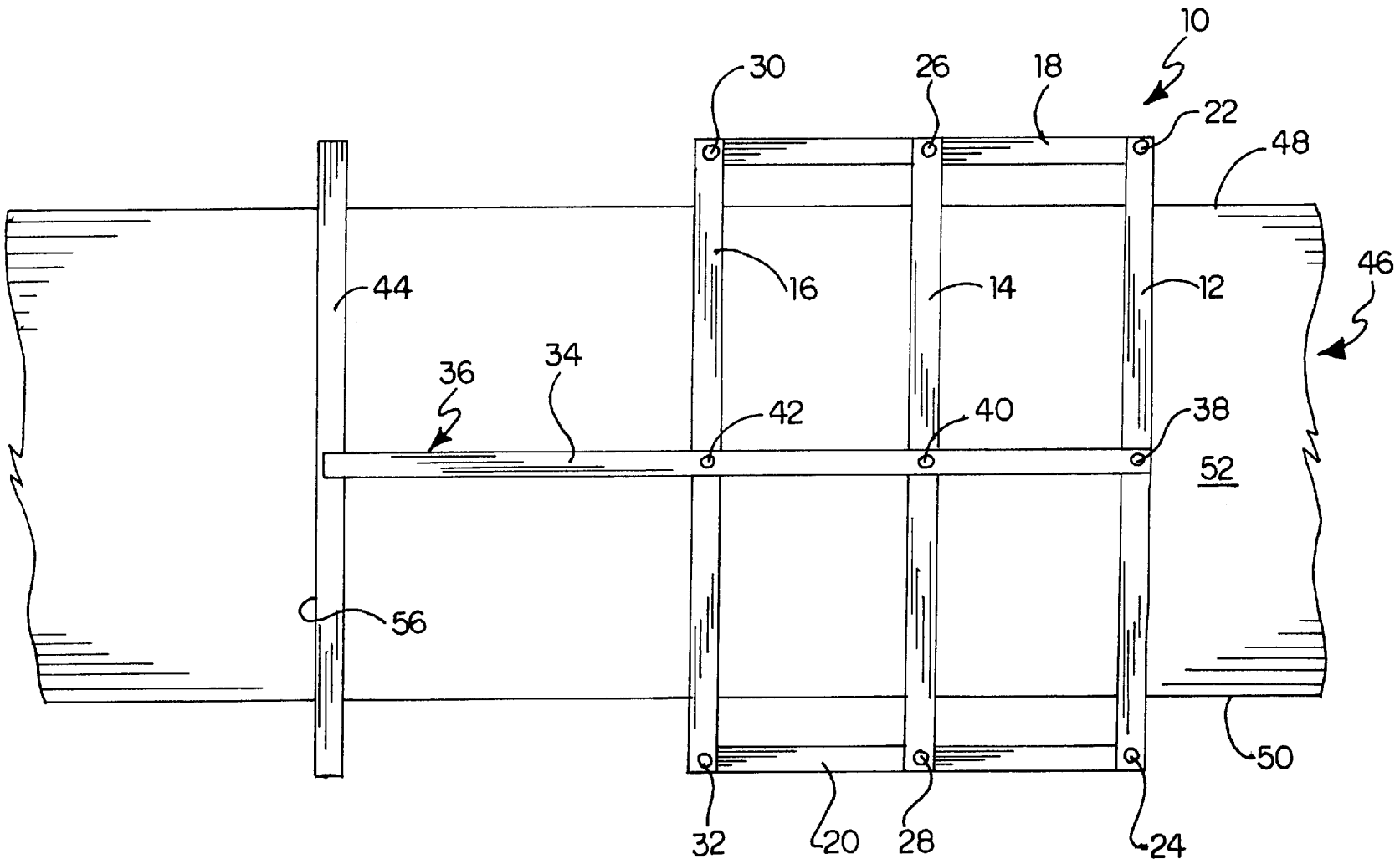
FIG. 2 is a top plan view of the squaring tool of the present invention placed on a conveyor belt which is to be cut square to the center line.
Figure 3:
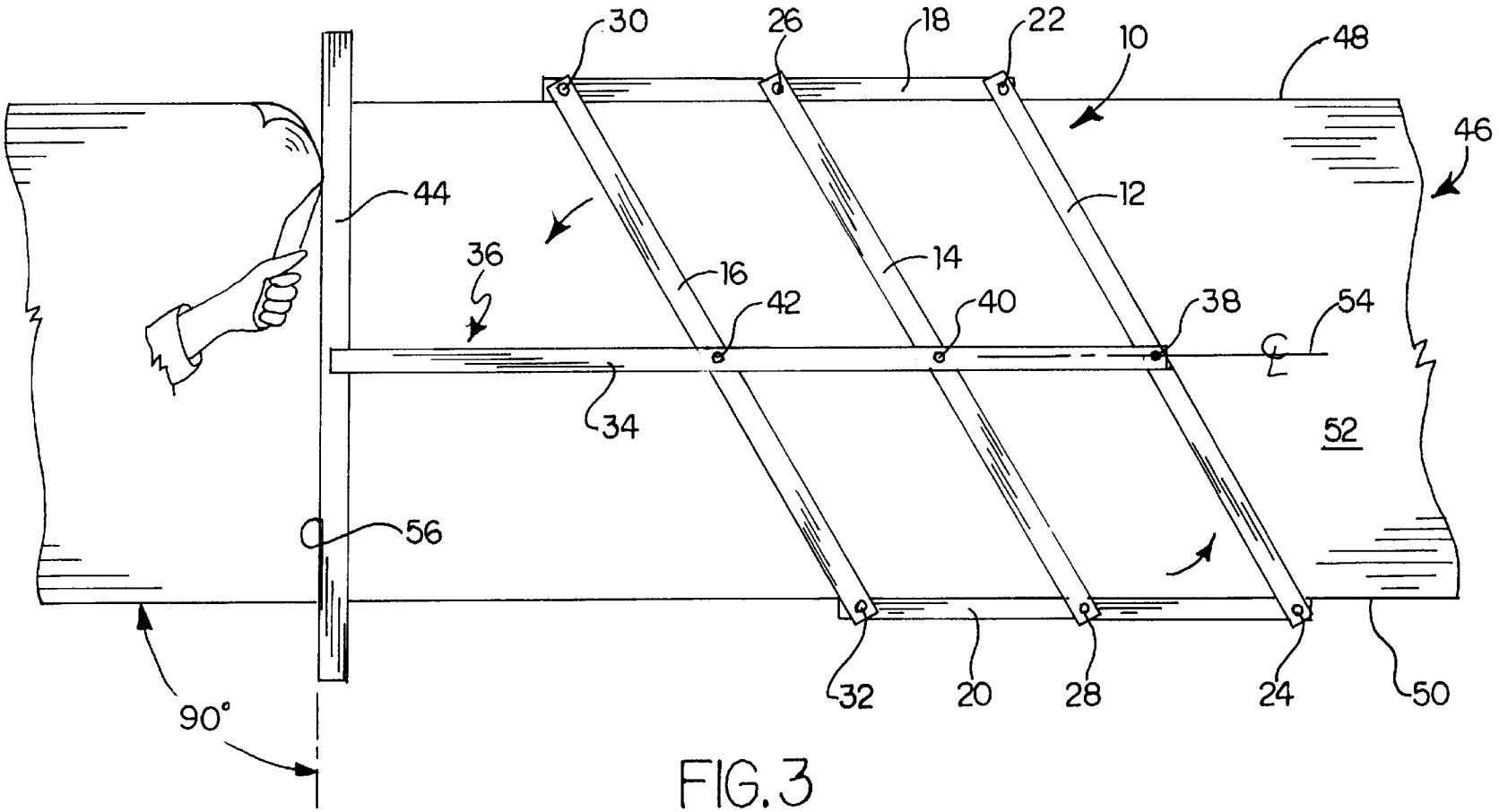
FIG. 3 is a view similar to FIG. 2, but illustrating the squaring tool engaged with the sides of the belt and the belt being cut square to the center line.

Referring to FIGS. 2 and 3, the squaring tool 10 is to be used to cut square the end of a conventional conveyor belt generally indicated by the numeral 46 having opposite side edges 48, 50 and an upper surface 52. The squaring tool 10 is laid on the upper surface 52 with the cross leg 44 at the location where the cut across the width of the belt is to be made and with the end links 18, 20 extending substantially parallel to the side edges 48, 50. The end links 18, 20 are then brought into engagement with the side edges 48, 50 while the cross leg 44 is maintained in position by pivoting the squaring tool 10 about the pivot connections 22–32 and 38–42, so that the cross links 12–16 extend diagonally across the width of the belt as illustrated in FIG. 3. Since the primary leg 34 is secured to each of the cross links 12–16 at the midpoint by the pivot connections 38, 40 and 42, the center of the primary leg 34 will lie upon the center line 54 of the belt 46 when the end links 18, 20 are brought into engagement with the side edges 48, 50. Accordingly, a cut may be made transversely across the width of the belt 52 that is square to the center line 54 by cutting along the outer edge of 56 of the cross leg 44. It will be noted that the tool 10 will accommodate a reasonably wide range of widths of belts, since the end links 18 and 20 are pivoted into engagement with the side edges of the belt. However, the squaring tool 10 may be manufactured in varying sizes to cut belts, which, is discussed above, may vary in width from four inches to four feet or even larger. By facilitating cutting of belts at right angles to the center line, the belt may be cut to length quickly and easily by using the tool 10 to square both ends of the belt that are to be laced together. Accordingly, the belt will run true on the supporting rollers (not shown) so that the belt will not "wander" from side to side.

I claim:

1. Tool for squaring the end of an elongated object having parallel side edges extending parallel to a centerline of the object comprising a T-square having a primary leg and a cross leg extending perpendicular to the primary leg, a pair of parallel cross links pivotally connected to the primary leg and extending transversely with respect to the sides of the belt, and a pair of end links extending parallel to said side edges, each of said end links being pivotally connected to each of said cross links, whereby said primary leg extends parallel to said side edges when the end links are engaged with the side edges and said cross leg defines an end line perpendicular to said primary leg along which a square end of the elongated object may be cut.

2. Tool as claimed in claim 1, wherein said primary leg is pivotally connected to the midpoint of the of the cross links, whereby said primary leg is located along the centerline when the end links are engaged with the sides of the belt and said end line is defined perpendicular to the centerline of the belt.

3. Tool as claimed in claim 2, wherein a third cross link extends parallel to said first and second cross links, said third cross link being pivotally connected to said primary leg and to each of said end links.

4. Tool as claimed in claim 3, wherein said end links are offset below said cross links to permit the cross links to rest on the elongated object while the end links engage the side edges.

5. Tool as claimed in claim 1, wherein said end links are offset below said cross links to permit the cross links to rest on the elongated object while the end links engage the side edges.

6. Method of cutting an end of a conveyor belt perpendicular to the centerline of the belt, said belt having a pair of side edges extending parallel to the centerline, including the steps of providing a squaring tool having a primary leg and a cross leg extending perpendicular to the primary leg, a pair of parallel cross links pivotally connected to the primary leg and extending transversely with respect to the sides of the belt, and a pair of end links extending parallel to said side edges, each of said end links being pivotally connected to each of said cross links, placing said cross links, said primary leg, and said cross leg on the belt with the end links offset from the edges of the belt, and pivoting the cross links and end links relative to the primary link to engage the end links with the edges of the belt, thereby moving said primary leg to a position parallel with the centerline of the belt, and then cutting an end on the belt by cutting along said cross leg.

7. Method of cutting conveyor belts as claimed in claim 6, wherein said primary leg is pivotally connected to the midpoint of the of the cross links, said method including the steps of locating said primary leg along the centerline of the belt by engaging said end links with the sides of the belt.

8. Method of cutting conveyor belts as claimed in claim 7, wherein a third cross link extends parallel to said first and second cross links, said third cross link being pivotally connected to said primary leg and to each of said end links.

9. Method of cutting conveyor belts as claimed in claim 7, wherein said method includes the step of offsetting said end links below said cross links to permit the cross links to rest on the elongated object while the end links engage the side edges.

* * * * *

UNITED STATES PATENT AND TRADEMARK OFFICE

CERTIFICATE OF CORRECTION

PATENT NO. : 6,195,903 B1
DATED : March 6, 2001
INVENTOR(S) : Brock Inglehart

It is certified that error appears in the above-identified patent and that said Letters Patent is hereby corrected as shown below:

Claim 1,
Line 2, after "object," insert -- the tool --
Lines 4 and 5, delete "the sides of the belt," and insert -- said primary link --
Line 5, delete "side edges" and insert -- primary link --
Line 7, delete first occurrence of "said"

Claim 2,
Line 2, delete second occurrence "of the"

Claim 3,
Line 1, after "claim 2," insert -- comprising first, second and third cross links --
Line 1, after "wherein," delete "a" and insert -- said --

Signed and Sealed this

Second Day of October, 2001

*Attest:*

Nicholas P. Godici

NICHOLAS P. GODICI
*Acting Director of the United States Patent and Trademark Office*

*Attesting Officer*